US005912610A

United States Patent [19]

Marinos et al.

[11] Patent Number: 5,912,610

[45] Date of Patent: Jun. 15, 1999

[54] HIGH ENERGY INDUCTOR

[75] Inventors: Charalampos D. Marinos, Minneapolis; Thomas M. Pfenning, Little Canada, both of Minn.

[73] Assignee: United Defense, LP, Arlington, Va.

[21] Appl. No.: 08/883,073

[22] Filed: Jun. 27, 1997

Related U.S. Application Data

[63] Continuation of application No. 08/540,931, Oct. 11, 1995, abandoned, which is a continuation of application No. 08/169,095, Dec. 20, 1993, abandoned.

[51] Int. Cl.[6] ..... H01F 27/30

[52] U.S. Cl. ..... 336/197; 336/208; 336/223

[58] Field of Search ..... 336/192, 223, 336/232, 197, 198, 208, 225

[56] References Cited

U.S. PATENT DOCUMENTS

| | | | |
|---|---|---|---|
| 3,464,109 | 9/1969 | Parker | 336/232 |
| 4,472,702 | 9/1984 | Johansson et al. | 336/197 |
| 5,050,293 | 9/1991 | Baldi et al. | 336/223 |
| 5,109,208 | 4/1992 | Murison | 336/223 |
| 5,296,830 | 3/1994 | Tamada et al. | 336/192 |

*Primary Examiner*—Thomas J. Kozma

*Attorney, Agent, or Firm*—Ronald C. Kamp; Douglas W. Rudy

[57] ABSTRACT

A high energy inductor and method of manufacture relates to an inductor which is capable of mechanically withstanding the high magnetic forces imposed thereon during transfer of high energy pulses. The inductor is wound with a conductor under tensile stress, wherein the conductor has a fixed inner end and a free outer end. The stress is maintained in the finished inductor by means of a clamp attached to and fixing the free end of the conductor. The fabrication method involves inducing tensile stress in the conductor as it is wound on an inductor core and then maintaining the conductor tensile stress in the finished inductor component.

5 Claims, 2 Drawing Sheets

HIGH ENERGY INDUCTOR

This application is a continuation of application Ser. No. 08/540,931 filed Oct. 11, 1995, now abandoned which is a continuation of application Ser. No. 08/169,095 filed Dec. 20, 1993, now abandoned.

SUMMARY OF THE INVENTION

An inductor is provided which has sufficient mechanical strength to withstand high magnetic field forces during transfer of high power pulses. The inductor includes a core assembly and an elongate electrical conductor having a first and second end. The conductor has a predetermined level of tensile stress imposed along the length thereof and is secured at the first end to the core assembly. The conductor is wound in a plurality of turns forming a coil around the core assembly. Means is provided for maintaining the predetermined tensile stress in the conductor coil, wherein such means is situated between the second end of the conductor and the coil assembly. Electrical insulation means is positioned between the turns of the coil.

An inductor is configured to withstand outwardly directed forces generated by high density magnetic fields during transfer of high power pulses. The inductor includes a core assembly and an elongate electrical conductor having one end secured to and wound in a plurality of turns about the core assembly. The conductor has a predetermined value of tensile stress imposed along the length thereof. Means is provided between the plurality of turns and the core assembly for preserving the predetermined value of tensile stress in the conductor. Electrical insulation means is located between the various ones of the plurality of turns of the conductor.

The method of the invention relates to fabrication of an inductor with high mechanical strength for withstanding high magnetic field forces during transfer of high power pulses. The inductor has a core and an electrical conductor wound thereon wherein the conductor has first and second ends. The steps of the method include securing the first conductor end in fixed position relative to the core, inducing a predetermined tensile stress in the conductor and, winding a plurality of turns of the conductor in coil-like fashion on the core. Further the method includes the steps of electrically insulating the plurality of turns from one another and securing the second end of the conductor in fixed position relative to the first end to thereby preserve the predetermined tensile stress in the conductor.

DESCRIPTION OF THE PREFERRED EMBODIMENTS

High pulse power circuits, for example circuits used in delivering high power pulses to chemical or electro thermal weapons systems, are subject to destruction by the extremely high magnetic field forces which result from the high pulse current flow. The destructive forces experienced in these applications are discussed to some extent in copending U.S. patent application Ser. No. 08/051,909 entitled HIGH ENERGY FLEXIBLE COAXIAL CABLE AND CONNECTIONS, filed Apr. 26, 1993 and assigned to the assignee of the instant application.

In brief, such high energy pulses involving high currents, generate magnetic forces which will cause an inductor to literally explode unless they are fabricated in a fashion to provide high mechanical strength. This means that the core of the inductor and the conductor wound in a coil about the core of the inductor must be heavy in construction and therefore must be of substantial weight and occupy considerable volume.

Inductors for use in high energy pulsed power circuit applications are sometimes of the well known "jelly roll" construction. These types of conductors have a core which readily conducts magnetic fields and a conductor wound in a coil and laid thereon, wherein the conductor is flat or strip-like having a somewhat thin rectangular cross section. In an effort to reduce the weight and volume of an inductor for use in pulsed power circuits, it has been found that sufficient resistance to the outwardly exerted or exploding forces caused by high magnetic fields resulting from the high current flow, may be obtained by imposing a predetermined tensile stress in the conductor as it is wound on the core to thereby create an inwardly directed force within the turns of the conductor coil to counteract the outwardly directed forces created by the high magnetic fields.

Figure 1:
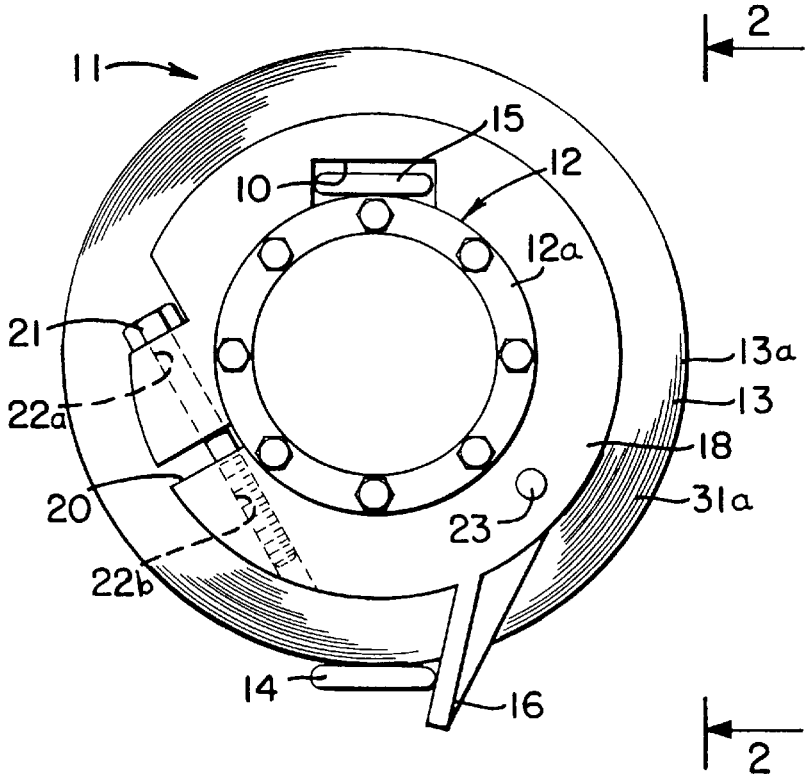
FIG. 1 is an elevation view of the inductor of the present invention.
Figure 2:
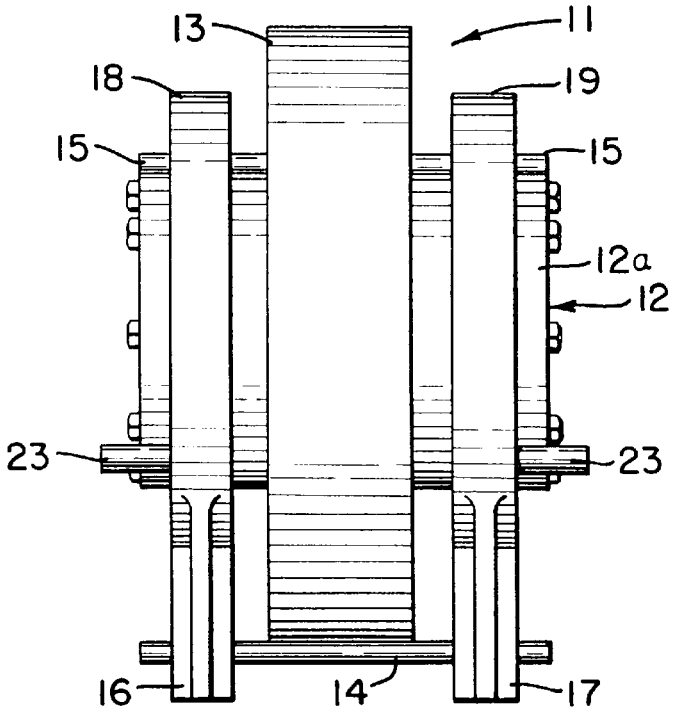
FIG. 2 is a view along the line 2—2 of FIG. 1.

An inductor 11 is shown in FIGS. 1 and 2 which has a core 12 assembly with a coil 13 wound thereon. The coil 13 is composed of a continuous flat conductor 13*a* wherein the width of the conductor as seen in FIG. 2 is considerably greater than the thickness of the conducting strip as seen in FIG. 1. The conducting strip may be of aluminum material or some other appropriate electrically conducting material. The turns of the wound coil 13 are separated electrically by insulation. The insulation may be a flat strip also, such as seen at 31*a* in FIG. 4 which may be wound on the coil simultaneously with the flat conducting strip, or the flat conducting strip may be processed to carry an integral insulation coating thereon. The core assembly 12 in this embodiment includes a core 12*a* on which are positioned a left flange 18 and a right flange 19, as best seen in FIG. 2.

One end of the continuous flat conducting strip 13*a* forming coil 13 as seen in FIGS. 1 and 2 is secured at the core assembly 12. A cross member 15 is secured to the conductor 13*a* at the inner ends thereof. The cross member passes through and is engaged by an aperture 10 formed in left and right flanges 18 and 19 to thereby fix the inner end of the conductor 13*a* in position relative to the core assembly 12. The opposite, or free end of the conducting strip 13*a* has an end piece 14 attached thereto which is engaged by a pair of arms 16 and 17 extending from left and right flanges 18 and 19, respectively. Each of the flanges 18 and 19 is split, at a slot 20, as seen in FIG. 1 and is secured to the core assembly 12 by means of a threaded bolt 21. The threaded bolt extends through a clearance hole 22*a* and across slot 20 as seen in FIG. 1, engaging threads 22*b* aligned with the clearance hole on the opposite side of the slot to thereby afford clamping action of the flange 18 on the core 12*a* when the bolt 21 is drawn up tight in the threads. The flange 19 is similarly configured for clamping to the core 12*a* although not visible in FIG. 1.

It may therefore be seen that the end member 14 secured to the free end of the conductor strip in the coil 13 is also held in fixed position relative to the core assembly 12 when it is engaged by the arms 16 and 17. As a result, the predetermined tension imposed along the length of the conductor strip 13*a* in the coil 13 is retained. The arms 16 and 17 are aligned to secure the end member 14 by means of a pin 23 which extends through the flanges 18 and 19.

Figure 3:
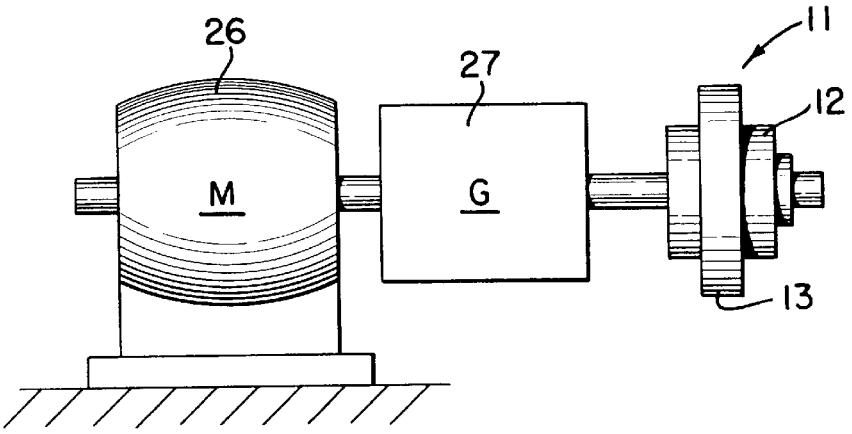
FIG. 3 is a partial diagram of one system for manufacturing the inductor of the present invention.

Turning now to FIG. 3 a motor 26 is shown mounted in a fixed position and having a gear box 27 connected to the motor output shaft. The gear box used in the preferred embodiment has a ratio of 1000 turns at the input to the gear box to one turn at the output thereof. As a result the output torque of the gear box 27 was approximately 1000 times the output torque of the motor 26. The core assembly 12, consisting in this embodiment of the core 12*a* and the flanges 18 and 19, is shown mounted on the output shaft of the gear box 27. The flat conductor coil 13 is shown being wound thereon.

Figure 4:
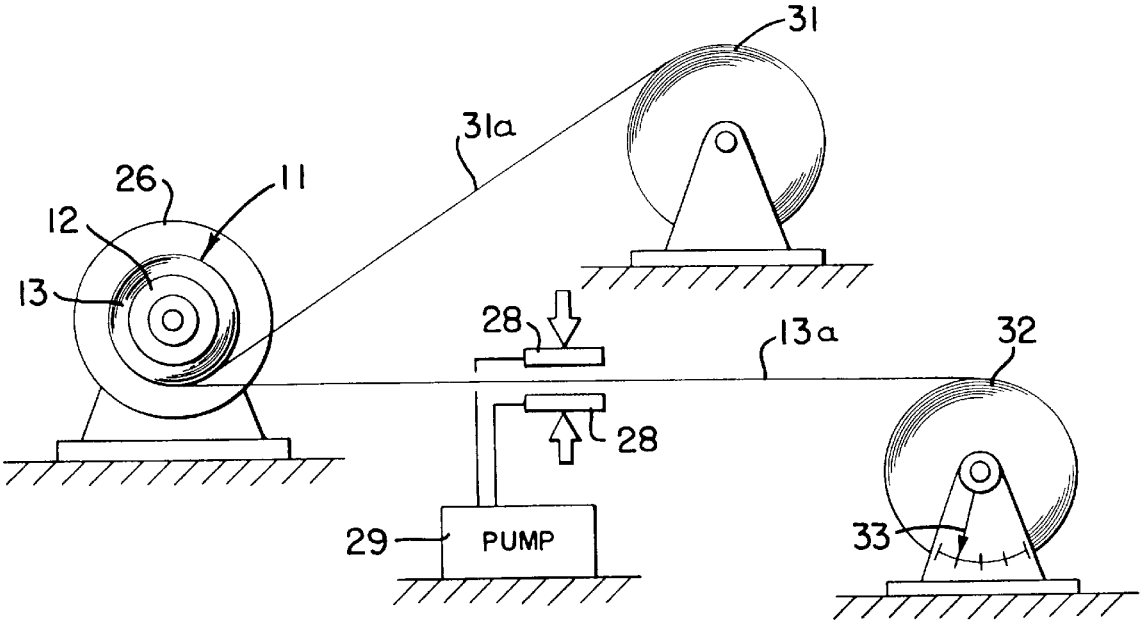
FIG. 4 is another diagram of the system for fabricating the inductor of the present invention.

FIG. 4 shows a pair of brake pads 28 positioned to contact the conductor strip 132 and to therefore impose a friction force thereon. A pump 29 provides pressure to actuators for the brake pads 28, wherein the applied pressure is readable. When the motor 26 is run and the output of the gear box 27 is at a particular speed, a sensing device such as a strain gauge (not shown) is placed on the flat conductor 13*a* between the coil 13 and the brake pads 28 to measure the tensile stress in the conductor strip 13*a*. A predetermined pressure provided by the pump 29 will provide a predetermined friction force at the brake pads 28 and will therefore provide a predetermined tension in the flat conductor strip 13*a* between the brake pads and the wound coil 13. The coil 13 of flat conductor 13*a* is therefore wound onto the core assembly 12 under a predetermined tensile stress.

As stated hereinbefore, a flat insulation strip 31*a* may be fed between the turns of the conductor 13*a* from a flat strip insulation feed coil 31 as seen in FIG. 4. Alternatively, the insulation may be attached to the flat strip conductor 13*a* by dipping or wrapping or some similar process prior to winding the conductor onto a core assembly. A conductor feed coil 32 (FIG. 4) is shown for feeding the conductor strip 13*a* onto the coil 13.

An alternative way to afford the predetermined stress level in the flat conductor strip 13*a* may be used without using the brake pads 28 or the pump 29. The flat conductor strip feed coil 32 may be mounted on a conductor strip feed device providing adjustable reaction torque at the axis of the feed coil 32. An adjustment device 33 for providing a predetermined reaction torque is itself well known to those of skill in this art and is shown in FIG. 4. Proper manipulation of the adjustment of device 33 will provide the predetermined tensile stress in conductor strip 13*a* when the motor 26 is operated and the conductor strip 13*a* is being wound onto a coil 13 at the output speed of the gear box 27.

A high energy inductor assembly is disclosed herein which serves in a circuit energized by a high energy pulse power facility producing from five to fifteen megajoules. A coil 13 was formed in accordance with the present invention using aluminum conducting strip four inches wide and ⅛th inch thick which therefore had ½ square inch cross sectional area and which was subjected to 10,000 pounds tensile force as the conducting strip 13*a* was wound onto the core assembly 12. There was therefore 20,000 pounds per square inch tensile force in the conductor as wound. The tensile force in the wound coil induces inward force in the coil when maintained therein, which counteracts the outward force generated by the high magnetic fields occurring during high pulse power transfer. As a result of the present invention, a lighter and smaller inductor is obtained wherein such weight and volume is only 25 percent of similar inductance jelly roll coils wound without tension imposed in the conducting strip.

Although the best mode contemplated for carrying out the present invention has been herein shown and described, it will be apparent that modification and variation may be made without departing from what is regarded to be the subject matter of the invention.

What is claimed is:

1. An inductor material providing high mechanical strength to withstand high magnetic field forces during transfer of high power pulses comprising:

a core assembly;

a left flange and a right flange carried on said core assembly, said flanges provided with an aperture in each flange, said flanges each having an arm extending therefrom;

an elongate conductor having a first and a second end and a prestressed section, said prestressed section prestressed to at least 20,000 psi along the length thereof;

a cross member secured to said first end of said conductor, said cross member passing through and engaged by said apertures in each of said flanges;

said conductor forming a coil around said core assembly;

an end piece attached to said second end of said conductor, said end piece in contact with each of said arms extending from said flange for maintaining said prestressed section of said conductor in said coil after said conductor is wound around said core; and electrical insulation means positioned between said turns of said coil.

2. An inductor material as in claim 1 wherein said elongate electrical conductor comprises a flat conductor strip, wherein said aluminum conducting strip comprises aluminum strips having ½ $in^2$ cross-sectional area.

3. The invention in accordance with claim 1 wherein each of said flanges are provided with a slot extending radially outward from the center of said flange, and said flanges are further provided with an adjustable fastener bridging said slot in said flange whereby said flange will be clamped to said core.

4. The invention in accordance with claim 1 wherein each of said flanges includes a clearance hole and a threaded hole aligned with said clearance hole, said holes on either side of said slot, said adjustable fastener passing through said clearance hole and into said threaded hole whereby said fastener can be tightened to clamp said flanges to said core assembly.

5. The invention in accordance with claim 4 wherein said flanges are provided with apertures; and a pin inserted in said apertures, said pin extending from one of said flanges to the other of said flanges whereby said flanges are connected together by said pin.

* * * * *